US009056468B2

(12) United States Patent
Yoneta

(10) Patent No.: US 9,056,468 B2
(45) Date of Patent: Jun. 16, 2015

(54) LIQUID DISCHARGE HEAD AND IMAGE FORMING APPARATUS

(71) Applicant: Ryohta Yoneta, Tokyo (JP)

(72) Inventor: Ryohta Yoneta, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/472,494

(22) Filed: Aug. 29, 2014

(65) Prior Publication Data

US 2015/0077471 A1 Mar. 19, 2015

(30) Foreign Application Priority Data

Sep. 13, 2013 (JP) ..... 2013-190679
Dec. 26, 2013 (JP) ..... 2013-268931

(51) Int. Cl.

| | |
|---|---|
| ***B41J 2/045*** | (2006.01) |
| ***B41J 2/14*** | (2006.01) |
| ***B41J 2/055*** | (2006.01) |
| ***B41J 2/175*** | (2006.01) |

(52) U.S. Cl.
CPC ..... *B41J 2/1433* (2013.01); *B41J 2/055* (2013.01); *B41J 2/17563* (2013.01)

(58) Field of Classification Search
CPC ..... B41J 2/17563; B41J 2/14233; B41J 2/14274; B41J 2/14048; B41J 2/145; B41J 2/161; B41J 2/1612; B41J 2/055
See application file for complete search history.

(56) References Cited

U.S. PATENT DOCUMENTS

| | | | | |
|---|---|---|---|---|
| 8,186,810 | B2 * | 5/2012 | Akahane | 347/68 |
| 2006/0007272 | A1 | 1/2006 | Ogata et al. | |
| 2010/0328409 | A1 | 12/2010 | Matsufuji et al. | |
| 2013/0233948 | A1 | 9/2013 | Yoneta | |
| 2014/0071215 | A1 | 3/2014 | Yoneta | |

FOREIGN PATENT DOCUMENTS

| | | |
|---|---|---|
| JP | 2005-125631 | 5/2005 |
| JP | 2011-025663 | 2/2011 |

OTHER PUBLICATIONS

U.S. Appl. No. 14/146,078, filed Jan. 2, 2014.
U.S. Appl. No. 14/186,106, filed Feb. 21,2014.
U.S. Appl. No. 14/324,354, filed Jul. 7, 2014.

* cited by examiner

*Primary Examiner* — Juanita D Jackson
(74) *Attorney, Agent, or Firm* — Cooper & Dunham LLP

(57) ABSTRACT

A liquid discharge head includes a nozzle plate, a channel plate, a wall member, and a common liquid chamber. The nozzle plate includes nozzles, and the channel plate forms a plurality of individual channels communicating with the nozzles. The wall member forms at least one portion of a wall of the plurality of individual channels. The common liquid chamber, arranged at a side opposite the plurality of individual channels, supplies liquid to the individual channel. The wall member includes a deformable damper area, a reinforced area, and an area of reduced thickness. The damper area forms one portion of a wall of the common liquid chamber, and the reinforced area divides the damper area into plural areas. The area of reduced thickness, arranged in at least one portion of the reinforced area, has a thickness greater than the damper area and less than the reinforced area.

4 Claims, 7 Drawing Sheets

LIQUID DISCHARGE HEAD AND IMAGE FORMING APPARATUS

CROSS-REFERENCE TO RELATED APPLICATIONS

This patent application is based on and claims priority pursuant to 35 U.S.C. §119 to Japanese Patent Application Nos. 2013-190679, filed on Sep. 13, 2013, and 2013-268931, filed on Dec. 26, 2013, in the Japan Patent Office, the entire disclosures of which are hereby incorporated by reference herein.

BACKGROUND

1. Technical Field

Exemplary aspects of the present invention relate to a liquid discharge head and an image forming apparatus including the liquid discharge head.

2. Related Art

An inkjet recording apparatus used as an image forming apparatus such as a printer, a facsimile machine, a copier, and a plotter includes an inkjet head serving as a liquid discharge head. The inkjet head includes nozzles, ink channels (hereinafter, also referred to as pressure liquid chambers) communicating with the nozzles, and pressure converters. The nozzles discharge ink droplets, and the pressure converters change pressure inside the ink channels to compress the ink.

For example, a piezoelectric pressure transducer is known as the pressure converter. The piezoelectric pressure transducer includes an electromechanical conversion element such as a piezoelectric element to generate pressure to be applied to ink inside a pressure liquid chamber that includes a wall formed of an elastically deformable wall member (a diaphragm). The piezoelectric element enables the wall member to be deformed by displacement of a drive unit. Such deformation of the wall member changes volume and therefore also pressure inside the pressure liquid chamber, thereby discharging ink droplets.

In addition to the piezoelectric element, a thermal actuator, a shape-memory alloy actuator, and an electrostatic actuator are known as pressure converters. The thermal actuator utilizes a phase change caused by film boiling of liquid by using an electrothermal conversion element such as a heat resistor. The shape-memory alloy actuator utilizes a metallic phase change caused by changes in temperature, whereas the electrostatic actuator utilizes electrostatic force.

In a case where droplets are discharged from the inkjet head, the pressure to be applied to the pressure liquid chamber needs to be increased. The pressure is generated to discharge the ink droplets. At the same time, the pressure is transmitted to a common liquid chamber used to supply ink. When this pressure is transmitted to the pressure liquid chamber again, pressure of the pressure liquid chamber fluctuates.

Particularly, in a case where an inkjet head with multiple nozzles for discharging ink is operated in a multichannel mariner, pressure fluctuation is large. The pressure fluctuation may cause resonance (mutual interference) of the pressure liquid chamber. Moreover, a resonance frequency of the vibration may match a drive frequency used during printing. If these frequencies match each other, the discharge of ink droplets is affected. This degrades image quality.

Accordingly, a pressure attenuation efficiency in the common liquid chamber needs to be enhanced to prevent such a situation, usually accomplished by increasing a volume of the common liquid chamber. Moreover, a damper (a pressure absorber) is provided between the pressure liquid chamber and the common liquid chamber to absorb pressure fluctuations inside the pressure liquid chamber.

For example, a liquid discharge head is capable of performing high-grade recording at high speed by efficiently attenuating pressure fluctuations while reducing resonance of a common liquid chamber. The liquid discharge head includes the common liquid chamber to supply liquid to a plurality of liquid chambers communicating with a plurality of respective nozzles. In a case where the liquid chambers are arranged in an X-direction, at least one wall of the common liquid chamber is provided in the X-direction and serves as a pressure-absorbing surface having lower rigidity than the other walls. In a case where a member that forms the pressure absorbing surface is divided into three portions in the X-direction, an average thickness of a center portion among the three portions is greater than that of each of both end portions.

SUMMARY

In at least one embodiment of this disclosure, there is provided an improved liquid discharge head including a nozzle plate, a channel plate, a wall member, and a common liquid chamber. The nozzle plate includes a plurality of nozzles that discharge droplets. The channel plate forms a plurality of individual channels communicating with the nozzles. The wall member forms at least one portion of a wall of the plurality of individual channel. The common liquid chamber is provided at a side opposite the plurality of individual channels with the wall member therebetween, and supplies liquid to the plurality of individual channels. The wall member includes a deformable damper area, a reinforced area, and an area of reduced thickness. The deformable damper area forms one portion of a wall of the common liquid chamber. The reinforced area divides the damper area into a plurality of areas in a nozzle arrangement direction. The area of reduced thickness is provided in at least one portion of the reinforced area, and has a thickness greater than the damper area and less than the reinforced area.

In at least one embodiment of this disclosure, there is provided an improved image forming apparatus including a liquid discharge head. The liquid discharge head includes a nozzle plate, a channel plate, a wall member, and a common liquid chamber. The nozzle plate includes a plurality of nozzles that discharge droplets. The channel plate forms a plurality of individual channels communicating with the nozzles. The wall member forms at least one portion of a wall of the plurality of individual channel. The common liquid chamber is provided at a side opposite the plurality of individual channels with the wall member therebetween, and supplies liquid to the plurality of individual channels. The wall member includes a deformable damper area, a reinforced area, and an area of reduced thickness, The deformable damper area forms one portion of a wall of the common liquid chamber. The reinforced area divides the damper area into a plurality of areas in a nozzle arrangement direction. The area of reduced thickness is provided in at least one portion of the reinforced area, and has a thickness greater than the damper area and less than the reinforced area.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
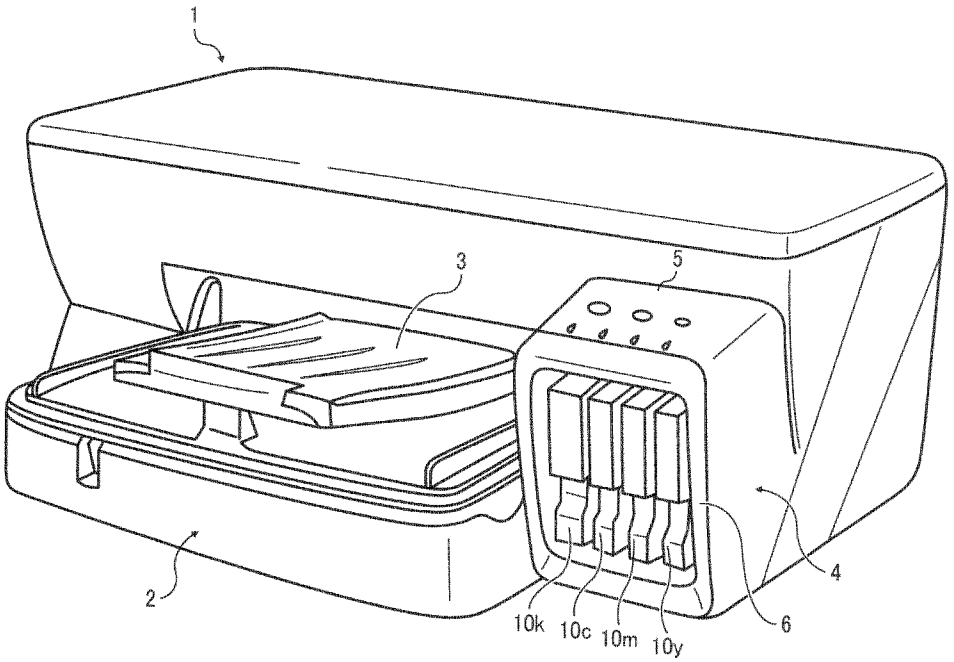
FIG. 1 is a perspective view of one example of an image forming apparatus according to an exemplary embodiment of the present invention.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, exemplary embodiments of the present disclosure are described below. In the drawings for explaining the following exemplary embodiments, the same reference codes are allocated to elements (members or components) having the same function or shape and redundant descriptions thereof are omitted below.

In a liquid discharge head, since an elastically deformable wall member (a diaphragm) forming a wall of a pressure liquid chamber needs to allow a volume of the pressure liquid chamber to be efficiently changed by displacement of a piezoelectric element, the surface of the pressure liquid chamber preferably has low rigidity. Moreover, in a case where the diaphragm includes a plurality of layers including a damper, the damper is preferably formed as thin as possible to absorb pressure fluctuations.

However, since the damper is a thin layer having a thickness of only a few μm, pinholes can be formed more easily. Consequently, an increase in area of the damper may not only increase the risk of failure, but also cause the damper to be damaged more easily when the diaphragm is removed from its base.

Accordingly, damper reinforcement is known to deal with such situations. For example, the damper of the diaphragm can be supported by a reinforcing member so that a damper area partitioned by the reinforcing member and a reinforced area including the reinforcing member are arranged.

However, the reinforced area including the reinforcing member has higher rigidity, whereas the damper area, which is not supported by the reinforcing member, has lower rigidity. That is, the diaphragm has two areas having different rigidities, causing greater distortion. In the manufacture of liquid discharge heads, such distortion of the diaphragm causes a bonding failure between the diaphragm and a channel member (a channel plate) forming an ink channel.

Hence, according to embodiments of the present disclosure, a liquid discharge head is provided to reduce distortion of an elastically deformable wall member that forms a wall of a pressure liquid chamber, and prevent a bonding failure between the wall member and a channel member.

Hereinafter, a liquid discharge head and an image forming apparatus according to an exemplary embodiment of the present invention are described with reference to the drawings.

An image forming apparatus 1 represents an apparatus forming an image by discharging liquid to a medium such as paper, thread, fiber, cloth, leather, metal, plastic, glass, wood, and ceramic. The term "image forming" represents not only a case where a meaningful image such as characters and graphics is provided on a medium, but also a case where a meaningless image such as patterns is provided on a medium. Moreover, the liquid to be discharged from a liquid discharge head 34 is not limited to recording liquid and ink. The liquid to be discharged from the liquid discharge head 34 should not be limited as long as image forming can be performed.

FIG. 1 is a perspective view of the image forming apparatus 1, as seen from a front side thereof, according to the exemplary embodiment of the present invention. The image forming apparatus 1 illustrated in FIG. 1 includes an apparatus body, a sheet feed tray 2 and a discharge tray 3. The sheet feed tray 2 is attached to the apparatus body to store sheets. The discharge tray 3 is detachably attached to the apparatus body. When an image is recorded (formed) on a sheet, the sheet is stacked on the discharge tray 3.

Moreover, the image forming apparatus 1 includes a cartridge holder 4 on one end side of a front surface (a side at which the sheet feed tray 2 and the discharge tray 3 are disposed) thereof so that an ink cartridge is attached. Moreover, the image forming apparatus 1 includes an operation/display unit 5 arranged on an upper surface of the cartridge holder 4. The operation/display unit 5 includes an operation button and a display. The cartridge holder 4 protrudes toward the front from the front surface of the apparatus body. The upper surface of the cartridge holder 4 is lower than that of the image forming apparatus 1.

The cartridge holder 4 enables a plurality of ink cartridges 10*k*, 10*c*, 10*m*, and 10*y* to be inserted and attached from the front toward the rear of the image forming apparatus 1. The ink cartridges 10*k*, 10*c*, 10*m*, and 10*y* store black (k), cyan (c), magenta (m), and yellow (y) ink of different color materials, respectively (each of the ink cartridges 10*k*, 10*c*, 10*m*, and 10*y* may be called "an ink cartridge 10" where color distinction is not necessary). On a front side of the cartridge holder 4, a front cover 6 serving as a cartridge cover is disposed. The cartridge cover 6 can be opened and closed. The front cover 6 is opened when the ink cartridge 10 is attached and detached.

Figure 2:
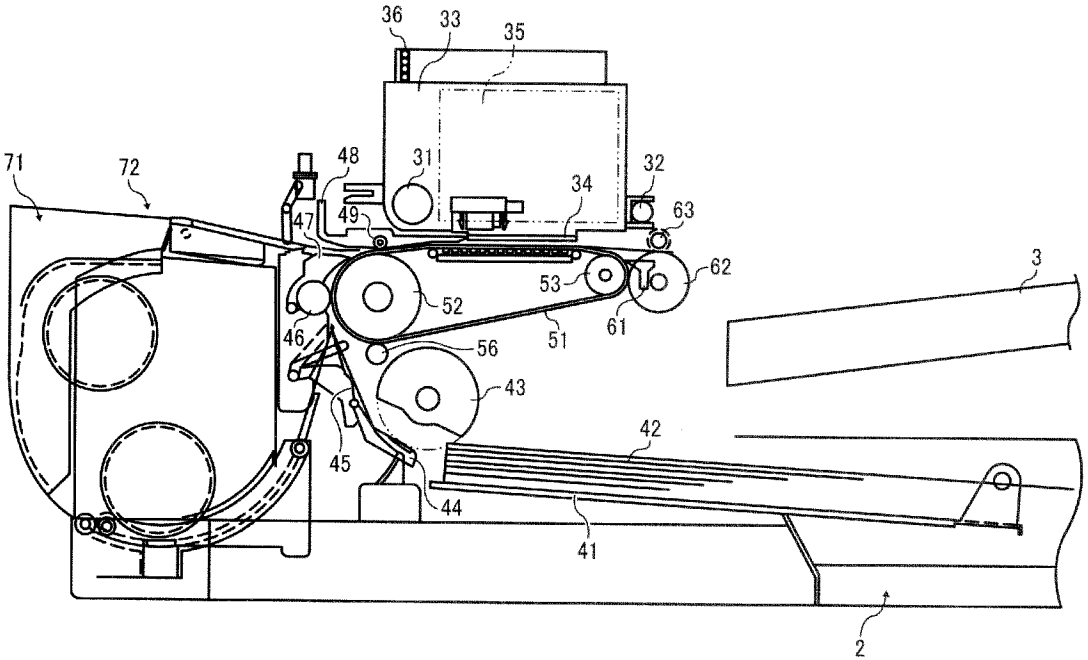
FIG. 2 is a sectional view of one example of a mechanical part of the image forming apparatus according to the exemplary embodiment of the present invention.
Figure 3:
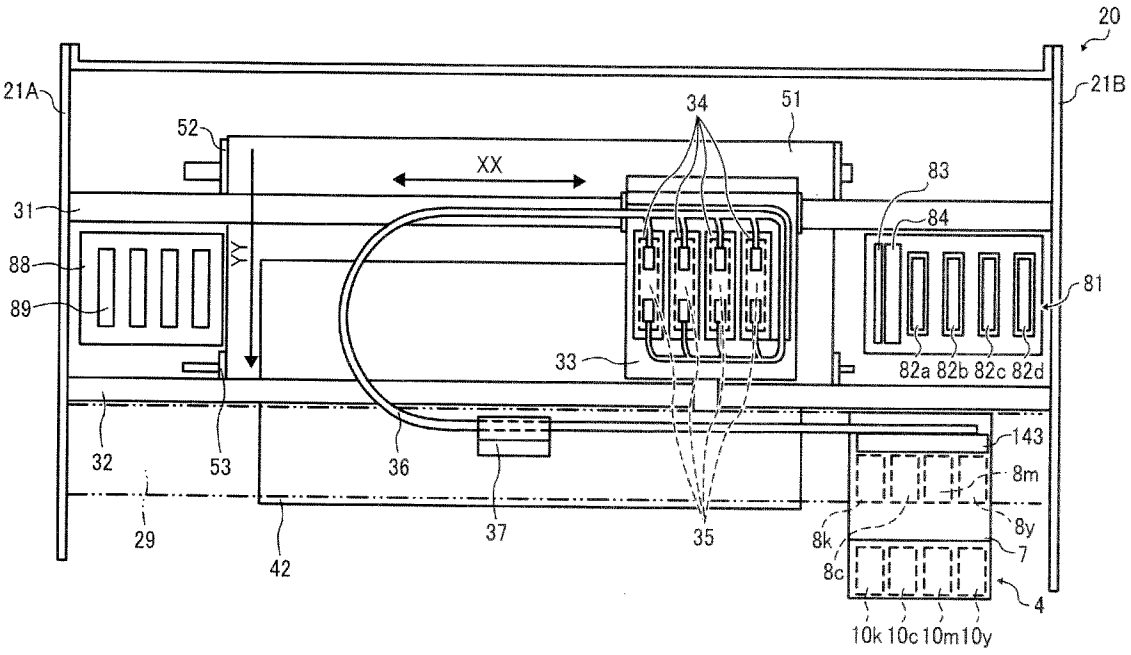
FIG. 3 is a top view of one example of a main portion of the image forming apparatus according to the exemplary embodiment of the present invention.

Next, mechanical parts of the image forming apparatus 1 are described with reference to FIGS. 2 and 3. In the image forming apparatus 1 according to the exemplary embodiment, ink is circulated. FIGS. 2 and 3 are a schematic side view and a plan view of the mechanical parts for circulating ink.

As illustrated in FIG. 3, the image forming apparatus 1 includes a guide rod 31 serving as a guide member, and a stay 32. The rod 31 and the stay 32 are laid horizontally across left and right side plates 21A and 21B to hold a carriage 33 so that the carriage 33 can slide in a main scanning direction indicated by an arrow XX shown in FIG. 3. The carriage 33 is moved by a main scanning motor though a timing belt to perform scanning in the main scanning direction XX (a carriage main scanning direction).

The carriage 33 includes the liquid discharge heads 34 discharging ink droplets of respective colors of yellow, cyan, magenta, and black. The liquid discharge head 34 includes a plurality of nozzles forming a nozzle row. The liquid discharge head 34 is attached to the carriage 33 such that an ink droplet discharging direction is faced downward and the nozzle row is provided in a sub-scanning direction indicated by an arrow YY shown in FIG. 3. The sub-scanning direction YY is perpendicular to the main scanning direction XX. Moreover, the carriage 33 includes a pressure damper unit 35 that suppresses pressure fluctuations generated when the carriage 33 performs the main scanning.

The liquid discharge head 34 can include a pressure generation unit that generates pressure to be used to discharge droplets. The pressure generation unit can be a piezoelectric actuator such as a piezoelectric element, a thermal actuator, a shape-memory alloy actuator, or an electrostatic actuator. The thermal actuator utilizes a phase change caused by film boiling of liquid by using an electrothermal conversion element such as a heat resistor. The shape-memory alloy actuator utilizes a metallic phase change caused by changes in temperature, whereas the electrostatic actuator utilizes electrostatic force.

The liquid discharge heads 34 receive ink supplied from respective sub-tanks 8*k*, 8*c*, 8*m*, and 8*y* (each of the sub-tanks 8*k*, 8*c*, 8*m*, and *y* may be called "a sub-tank 8" where color distinction is not necessary). The sub-tanks 8 are provided in a predetermined position, and the ink stored in the sub-tank 8 is supplied to the liquid discharge head 34 through an ink supply tube 36 of a corresponding color, The ink cartridges 10*k*, 10*c*, 10*m*, and 10*y* attached to the cartridge holder 4 replenish the sub-tank 8*k*, 8*c*, 8*m*, and 8*y* with the respective color ink. Moreover, the cartridge holder 4 includes a supply pump unit 7 to convey the ink inside the ink cartridges 10.

A holding member 37 on a front stay 29 holds a middle portion of the ink supply tube 36. When the liquid discharge head 34 is filled with ink, the ink is conveyed by a circulation pump 143 with the liquid discharge head 34 being covered with a cap 82. The cap 82 will be described below. When the circulation pump 143 is driven, air inside the liquid discharge head 34 and the ink supply tube 36 is conveyed to the sub-tank 8. This operation enables the liquid discharge head 34 and the ink supply tube 36 to have negative pressure thereinside, thereby filling the liquid discharge head 34 and the ink supply tube 36 with ink. That is, the ink is circulated between the sub-tank 8 and the liquid discharge head 34 though the ink supply tube 36. The image forming apparatus 1 also includes a frame 20.

Meanwhile, as illustrated in FIG. 2, the image forming apparatus 1 includes a semicircular roller (sheet feed roller) 43 and a separation pad 44 that serve as a sheet feed unit for feeding sheets 42 stacked on a sheet stacking unit (a pressure plate) 41 of the sheet feed tray 2. The sheet feed roller 43 feeds the sheets 42 one by one from the sheet stacking unit 41. The separation pad 44 is made of a material having a higher friction coefficient, and is disposed opposite the sheet feed roller 43. The separation pad 44 is urged towards the sheet feed roller 43 side.

The sheet 42 fed from the sheet feed unit needs to be conveyed to a lower side of the liquid discharge head 34. Accordingly, the image forming apparatus 1 includes a guide member 45 for guiding the sheet 42, a counter roller 46, a conveyance guide member 47, a presser member 48 including a leading-edge pressure roller 49, and a conveyance belt 51 serving as a conveyance unit. The conveyance belt 51 electrostatically adsorbs the fed sheet 42 to convey the sheet 42 to a position opposite the liquid discharge head 34.

The conveyance belt 51 is an endless belt. The conveyance belt 51 is looped around a conveyance roller 52 and a tension roller 53 to move around in a belt conveyance direction (the sub-scanning direction YY). Moreover, the image forming apparatus 1 includes a charging roller 56 serving as a charging unit to charge a surface or the conveyance belt 51. The charging roller 56 contacts a surface layer of the conveyance belt 51, and is rotated by rotation of the conveyance belt 51. The conveyance belt 51 moves circularly in the belt conveyance direction (the sub-scanning direction YY) with rotation of the conveyance roller 52 driven by a sub-scanning motor.

Moreover, the image forming apparatus 1 includes a separation pawl 61 for separating the sheet 42 from the conveyance belt 51, a discharge roller 62, and a discharge roller 63. The separation pawl 61, the discharge roller 62, and the discharge roller 63 serve as a sheet discharge unit for discharging the sheet 42 on which an image is recorded by the liquid discharge head 34. The discharge tray 3 is provided below the discharge roller 62.

Moreover, the image forming apparatus 1 includes a duplex unit 71 detachably attached to a backside thereof. The duplex unit 71 receives the sheet 42 moved back by reverse rotation of the conveyance belt 51 to reverse the sheet 42. The duplex unit 71 feeds the reversed sheet 42 to an area between the counter roller 46 and the conveyance belt 51 again. An upper surface of the duplex unit 71 serves as a manual tray 72.

Moreover, as illustrated in FIG. 3, the image forming apparatus 1 includes a maintenance unit 81 including a recovery unit. The maintenance unit 81 is provided in a blank area on one end in the main scanning direction XX of the carriage 33 to maintain a state of the nozzles of the liquid discharge head 34.

The maintenance unit 81 includes cap members (hereinafter called "caps") 82*a*, 82*b*, 82*c*, and 82*d* (each of the caps 82*a*, 82*b*, 82*c*, and 82*d* may be called the "cap 82" where distinction is not necessary), a wiper blade 83, and an idle discharge receiver 84. Each of the caps 82*a*, 82*b*, 82*c*, and 82*d* covers a nozzle face of the liquid discharge head 34. The wiper blade 83 serving as a blade member wipes the nozzle face. The idle discharge receiver 84 receives droplets dropped when an idle discharge operation is performed to discharge thickened ink, the idle discharge operation discharging droplets not contributing to recording.

Moreover, as illustrated in FIG. 3, the image forming apparatus 1 includes an idle discharge receiver 88 in a blank area on the other end in the main scanning direction XX of the carriage 33. The idle discharge receiver 88 includes an opening 89 arranged along a direction of the nozzle row of the liquid discharge head 34. The idle discharge receiver 88 receives the droplets dropped by the idle discharge operation, which allows thickened ink to he discharged during recording to discharge ink droplets not contributing to recording.

In such a configuration of the image forming apparatus 1 including the liquid discharge head 34, the sheets 42 are fed one by one from the sheet feed tray 2, and each of the sheets 42 fed upward in a substantially vertical direction is guided by the guide member 45. The sheet 42 is then conveyed by being nipped by the conveyance belt 51 and the counter roller 46. A leading edge of the sheet 42 is further guided by the conveyance guide member 47. and pressed toward the conveyance belt 51 by the leading-edge pressure roller 49 to change the conveyance direction of the sheet 42 by substantially 90 degrees.

Herein, positive outputs and negative outputs are repeatedly and alternately applied to the charging roller 56, that is, an alternating current voltage is applied to the charging roller 56. Such application of the alternating current voltage enables the conveyance belt 51 to be charged with an alternating charging voltage pattern. In other words, the conveyance belt 51 is alternately charged to have a band pattern in the sub-scanning direction YY which is the belt conveyance direction, the band pattern including positive areas and negative areas each having a predetermined bandwidth.

When the sheet 42 is conveyed to the conveyance belt 51 charged alternately with the positive and negative voltages, the sheet 42 is attracted to the conveyance belt 51. With the circular movement of the conveyance belt 51, the sheet 42 is conveyed in the sub-scanning direction YY.

Accordingly, the liquid discharge head 34 is driven in response to image signals while the carriage 33 is moving. This enables the liquid discharge head 34 to discharge ink droplets to the sheet 42 being brought to a halt, so that one line is recorded on the sheet 42. Subsequently, the sheet 42 is conveyed by a predetermined distance, and a next line is recorded on the sheet 42. Upon receipt of a recording end signal or a signal indicating that a tailing edge of the sheet 42 has reached a recording area, the image forming apparatus 1 finishes the recording operation, and discharges the sheet 42 to the discharge tray 3.

When the image forming apparatus 1 is on standby, that is, when printing or recording is not being performed, the carriage 33 is moved to a side at which the maintenance unit 8*l* is disposed, whereas the liquid discharge head 34 is covered with the cap 82. Accordingly, the nozzle is maintained in a moist state, thereby preventing a discharge failure caused by dryness of ink. Moreover, while the liquid discharge head 34 is covered with the cap 82, the maintenance unit 81 performs a recovery operation for discharging thickened ink and bubbles by allowing a suction pump to suction the thickened ink and the bubble from the nozzle (such an operation is called "nozzle suction" or "head suction"). Moreover, the maintenance unit 81 performs the idle discharge operation for discharging ink not necessary for recording before a recording operation is started or during recording. This maintains stable dischargeability of the liquid discharge head 34.

Figure 4:
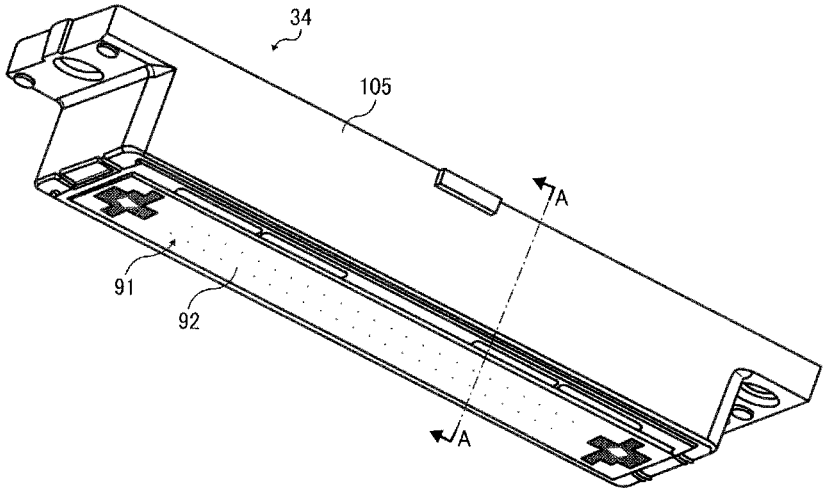
FIG. 4 is an external view of one example of a liquid discharge head according to an exemplary embodiment of the present invention.
Figure 5:
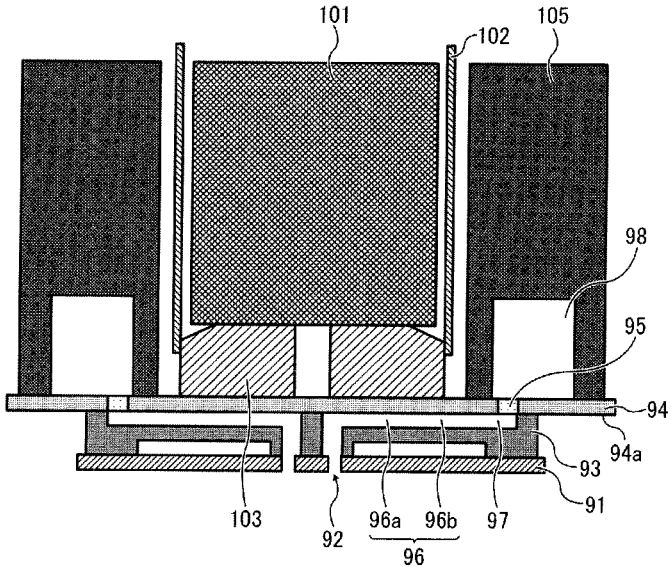
FIG. 5 is a schematic sectional view along the line A-A of FIG. 4.

Next, an example of the liquid discharge head 34 is described with reference to FIGS. 4 and 5. FIG. 4 is an external view of the liquid discharge head 34, and FIG. 5 is a schematic sectional view along the line A-A of FIG. 4.

The liquid discharge head 34 includes a nozzle plate 91, a channel plate 93, a wall member 94, and an individual channel 96. The nozzle plate 91 includes a plurality of nozzle rows each formed by linearly arranging a plurality of nozzles 92 for discharging droplets. For example, the nozzle plate 91 is made by nickel electroforming. The nozzle plate 91, the channel plate 93, and the wall member 94 are laminated to form the individual channel 96. Each of the plurality of nozzles 92 for discharging droplets communicates with the individual channel 96, Herein, the individual channel 96 includes a pressure chamber 96*a* and a fluid-resistant portion 96*b*. The fluid-resistant portion 96*b* also serves as a supply path when ink is supplied to the pressure chamber 96*a*. The fluid-resistant portion 96*b* communicates with a liquid introduction area 97. The liquid introduction area 97 is a portion arranged opposite a filter 95 allowing ink to be supplied from a common liquid chamber 98. The fluid-resistant portion 96*b* between the pressure chamber 96*a* and the liquid introduction area 97 serves as a supply path that has a channel having a smaller cross-section than the pressure chamber 96*a*. Alternatively, the individual channel 96 may not include the fluid-resistant portion 96*b*. In such a case, the liquid introduction area 97 and the pressure chamber 96*a* directly communicate with each other. In this case, the individual channel 96 is formed by the pressure chamber 96*a*.

The individual channel 96 receives liquid ink supplied from the common liquid chamber 98 through the filter 95. Moreover, the liquid discharge head 34 includes a piezoelectric element 103 serving as a drive unit (a pressure converter, an actuator) for generating pressure to be applied to ink of the pressure chamber 96*a*. The piezoelectric element 103 is bonded to a base 101 such that the piezoelectric element 103 corresponds to a row of the nozzles 92. Particularly, two piezoelectric elements 103 are arranged for the respective rows of the nozzles 92. The piezoelectric element 103 is provided to contact the wall member 94 in a state that a flexible printed circuit (FPC) 102 for driving the piezoelectric element 103 is connected to the piezoelectric element 103. When the wall member 94 is deformed by displacement of the piezoelectric element 103, the pressure inside the pressure chamber 96*a* increases. Such an increase in pressure allows the ink inside the pressure chamber 96*a* to be discharged from the nozzle 92 as droplets. Hereinafter, the nozzle plate 91, the channel plate 93, the wall member 94, the piezoelectric element 103, the base 101, and the FPC 102 may be collectively called a head unit.

A frame member 105 forms the common liquid chamber 98, and includes a liquid supply port and an opening. The liquid supply port is provided to supply ink from an external liquid supply unit such as the ink cartridge 10 and the sub-tank 8 to the common liquid chamber 98 for each nozzle row. The opening is provided to house a piezoelectric unit including the piezoelectric element 103 and the base 101.

Figure 6:
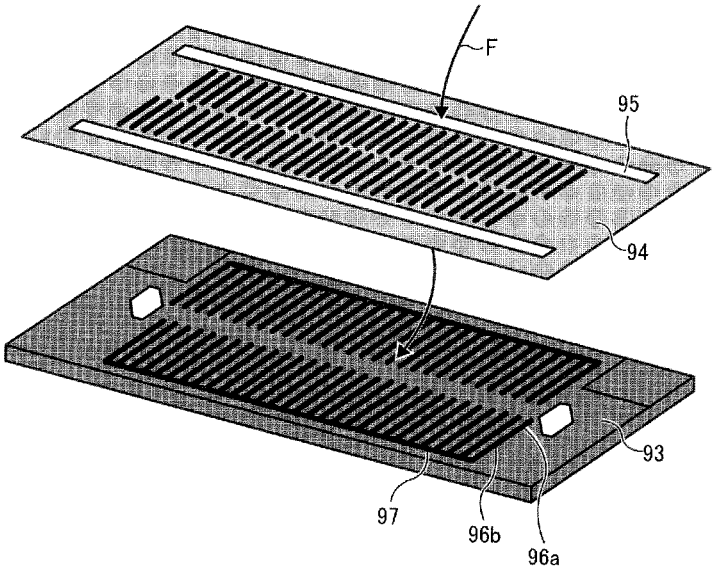
FIG. 6 is a schematic view of a structure including a wall member and a channel plate, and a flow of ink.

As illustrated in FIG. 5, the liquid discharge head 34 according to the exemplary embodiment of the present invention includes the nozzle plate 91, the channel plate 93, the common liquid chamber 98, and the wall member 94. The nozzle plate 91 includes the plurality of nozzles 92 discharging droplets. The channel plate 93 forms the plurality of individual channels 96 communicating with the nozzles 92, and the liquid introduction area 97 communicating with the individual channel 96. The common liquid chamber 98 supplies liquid to the plurality of individual channels 96, and the wall member 94 forms at least one portion of a wall of the individual channel 96. The common liquid chamber 98 is provided at a side opposite the individual channel 96 with the surface member 94 therebetween. FIG. 6 illustrates a structure of the wall member 94 and the channel plate 93. When ink flows from the common liquid chamber 98, the ink passes the filter 95 arranged in the wall member 94 and is conveyed to the individual channel 96 through the liquid introduction area 97 of the channel plate 93. Such a flow of the ink is indicated by an arrow F shown in FIG. 6. The individual channel 96 is partitioned by partition walls. Each of the partition walls may be communicated in a nozzle row direction near the liquid introduction area 97. Although the arrangement of the filter 95 in the wall member 94 may decrease a flow of ink due to a foreign substance that clogs the filter 95, the communication of the partition walls every 8 channels or 16 channels of the individual channel 96 can prevent a decrease in the ink flow.

Figure 7A:
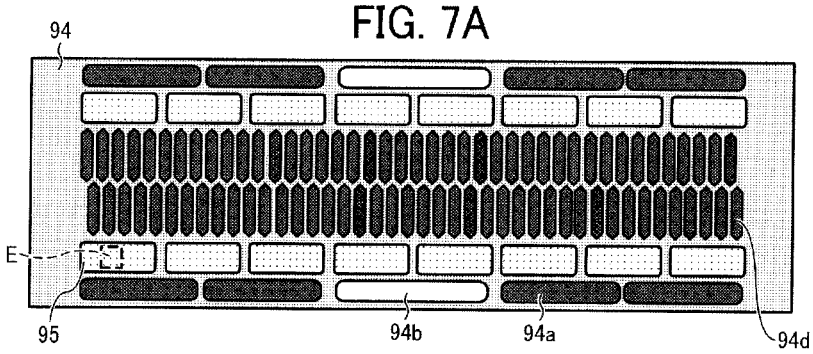
FIG. 7A is a plan view of one example of the wall member including a filter.
Figure 7B:
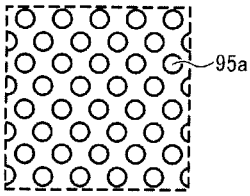
FIG. 7B is an enlarged view of the filter of the wall member.

FIG. 7A is a plan view of the wall member 94 including the filter 95, and FIG. 7B is an enlarged view of an area E of the filter 95. The filter 95 includes filter holes 95*a*. Preferably, the filter holes 95*a* have a diameter of between 10 μm and 20 μm to prevent clogging. Moreover, since a larger number of the filter holes 95*a* per unit area can suppress an increase in pressure loss, the filter holes 95*a* are preferably arranged in a staggered pattern as illustrated in FIG. 7B.

The filter 95 may have be a continuous opening cross an area in which liquid is introduced. However, in a case where the filter 95 is divided into a plurality of sections in a nozzle arrangement direction as illustrated in FIG. 7A, strength near the filter 95 can be maintained. Particularly, a plurality of ribs is formed with space therebetween, the space corresponding each of two or more liquid chambers in the nozzle arrangement direction (see JP-2011-25663-A). These ribs can divide the filter 95 into a plurality of sections.

Figure 8A:
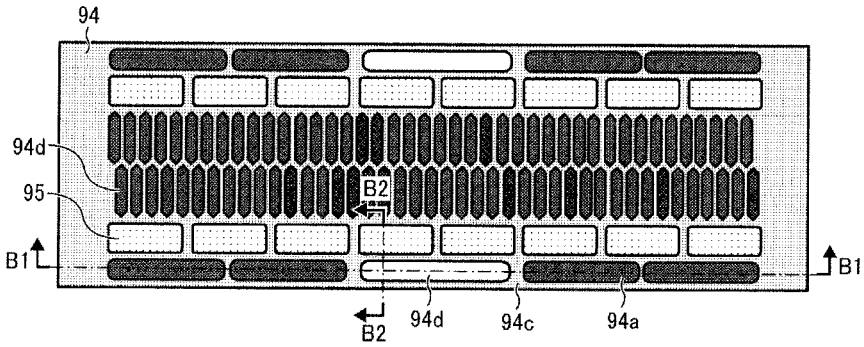
FIG. 8A is a plan view of one example of the wall member according to the exemplary embodiment of the present invention.
Figure 8B:
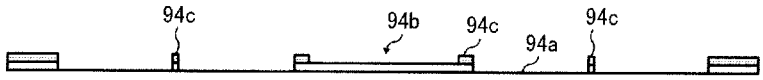
FIG. 8B is a schematic sectional view along the line B1-B1 of FIG. 8A.
Figure 8C:
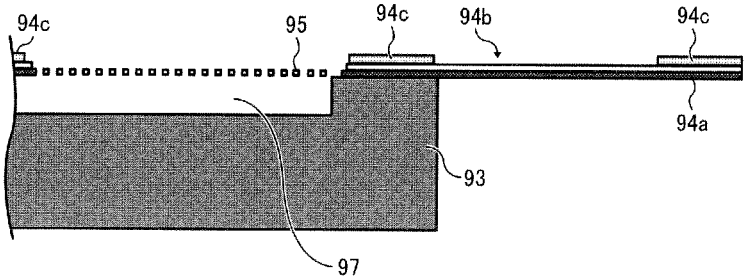
FIG. 8C is a schematic sectional view along the line B2-B2 of FIG. 8A.

FIGS. 8A, 8B, and 8C are a plan view of the wall member 94 according to the exemplary embodiment of the present invention, a schematic sectional view along the line B 1-BI of FIG. 8A, and a schematic sectional view along the line B2-B2 of FIG. 8A, respectively. In the sectional view illustrated in FIG. 8B, an upper side indicates a side that faces the common liquid chamber 98. The cross section illustrated in FIG. 8C includes the channel plate 93, in addition to the wall member 94. The wall member 94 of the liquid discharge head 34 includes an elastically deformable damper area 94*a*, a reinforced area 94*c*, and a diaphragm 94*d*. The damper area 94*a* serves as one portion of a wall of the common liquid chamber 98. The reinforced area 94*c* divides the damper area 94*a* into a plurality of areas in the nozzle arrangement direction. Moreover, the wall member 94 includes an area of reduced thickness 94*b* (hereinafter called a recessed area 94*b*) in at least one portion of the reinforced area 94*c*, the recessed area 94*b* being thicker than the damper area 94*a* and thinner than the reinforced area 94*c*.

The wall member 94 is a diaphragm having a plurality of layers. For example, the wall member 94 is formed of a nickel plate and manufactured by electroforming.

In the wall member 94 having a plurality of layers, for example, a first layer, a second layer, and a third layer are laminated in this order from a side at which the individual channel 96 is provided. Accordingly, the damper area 94*a*, the recessed area 94*b*, and the reinforced area 94*c* are formed in a one-layer structure, a two-layer structure, and a three-layer structure, respectively. The damper area 94*a* is preferably made of a material such as nickel (metal) having low air permeability. However, the damper area 94*a* may be made of a plastic film.

Figure 9A:
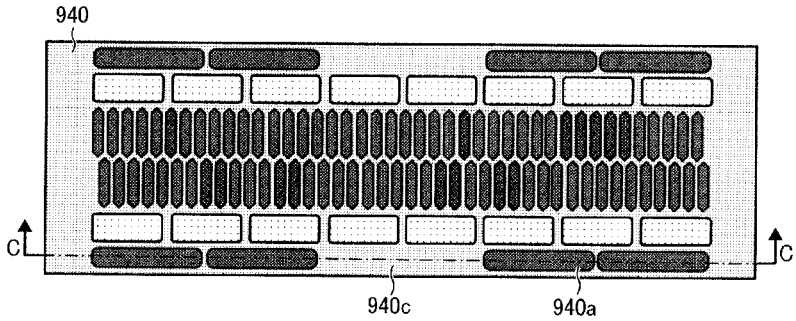
FIG. 9A PRIOR ART
FIG. 9A is a plan view of one example of a related-art wall member.
Figure 9B:
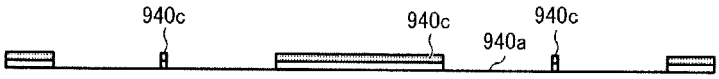
FIG. 9B PRIOR ART
FIG. 9B is a schematic sectional view along the line C-C of FIG. 9A.
Figure 10A:
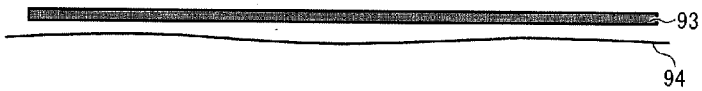
FIG. 10A is a schematic diagram of distortion of a wall member according to an exemplary embodiment of the present invention.
Figure 10B:
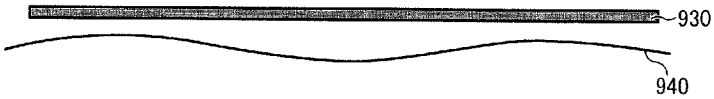
FIG. 10B PRIOR ART
FIG. 10B is a schematic diagram of distortion of a related-art wall member.

FIGS. 8A, 8B, 8C, 9A, 9B, 10A, and 10B describe a comparison between the wall member 94 including the recessed area 94*b* according to the exemplary embodiment of the present invention and a related-art wall member 940. FIG. 9A is a plan view illustrating an example of the related-art wall member 940. FIG. 9B is a sectional view along the line C-C of FIG. 9A. In the sectional view illustrated in FIG. 9B, an upper side indicates a side that faces a related-art common liquid chamber. FIG. 10A is a schematic diagram of the wall member 94 which is bonded to the channel plate 93 according to the exemplary embodiment of the present invention. FIG. 10B is a schematic diagram of the related-art wall member 940 which is bonded to a channel plate 930.

As illustrated in FIGS. 9A and 9B, the related-art wall member 940 includes a deformable damper area 940*a* and a reinforced area 940*c*. The damper area 940*a* serves as one portion of a wall of the common liquid chamber, whereas the reinforced area 940*c* divides the damper area 940*a* into a plurality of areas. In the wall member 940 illustrated in FIGS. 9A and 9B, the reinforced area 940*c* between the divided areas of the damper area 940*a* is large, that is, an area having higher rigidity is large. Consequently, the damper area 940*a* and the reinforced area 940*c* have different rigidities, causing large distortion. The related-art wall member 940 with such large distortion is not easily and evenly bonded to the channel plate 93, as illustrated in FIG. 10B.

On the other hand, in the liquid discharge head 34 according to the exemplary embodiment of the present invention, as illustrated in FIGS. 8A, 8B, and 8C, the wall member 94 includes the deformable damper area 94*a* serving as one portion of the wall of the common liquid chamber 98, and the reinforced area 94*c* dividing the damper area 94*a* into a plurality of areas. Moreover, the wall member 94 includes the recessed area 94*b*, which is thinner than the damper area 94*a* and thicker than the reinforced area 94*c*, arranged in at least one portion of the reinforced area 94*c*. The arrangement of the recessed area 94*b* forms an area having a lower rigidity than the reinforced area 94*c*, thereby reducing distortion of the wall member 94 serving as a diaphragm. The wall member 94 having a small distortion as illustrated in FIG. 10A can be evenly bonded to the channel plate 93, so that a bonding failure can be suppressed, compared to the prior-art case illustrated in FIG. 10B.

The example of the wall member 94 illustrated in FIGS. 8A, 8B, and 8C includes one recessed area 94*b* in the nozzle arrangement direction. However, the wall member 94 may have a plurality of recessed areas 94*b* in the nozzle arrangement direction. Moreover, a plurality of recessed areas 94*b* may be arranged in a direction perpendicular to the nozzle arrangement direction.

In the exemplary embodiment of the present invention, the wall member 94 serves as a diaphragm having a plurality of layers, and the deformable damper area 94*a* serves as one of the layers of the diaphragm. The wall member 94 illustrated in FIGS. 8A, 8B, and 8C includes three layers as an example structure. Since a damper is preferably formed as thin as possible to absorb pressure fluctuations, the damper (the damper area 94*a*) is formed in the one-layer structure. The arrangement of the recessed area 94*b* lowers the rigidity of the reinforced area 94*c* partitioning the damper area 94*a*, so that distortion of the wall member 94 is suppressed. Since the recessed area 94*b* is formed in the two-layer structure, the arrangement of the recessed area 94*b* can prevent the risk of a failure such as pinholes generated when only the wall member 94 of the one-layer structure is provided. Moreover, the two-layer structure can suppress distortion of the wall member 94, the distortion being caused by high rigidity of the reinforced area 94*c* formed in the three-layer structure.

The wall member 94 serving as a diaphragm is preferably made by nickel electroforming. The wall member 94 with the plurality of layers has a thickness that varies depending on a portion thereof whether the damper area 94*a*, the reinforced area 94*c*, or the recessed area 94*b* is provided. Such a wall member 94 is suitably formed by laminating nickel. This can allow the wall member 94 to have different functional layers.

A structure of the wall member 94 is not limited to the lamination structure. For example, a single layer member may form a wall of the common liquid chamber 98, the wall being on which the damper area 94*a* is formed. In such a case, a thinnest area and a thickest area are preferably set as the damper area 94*a* and the reinforced area 94*c*, respectively, whereas an area thicker than the damper area 94*a* and thinner than the reinforced area 94*c* is preferably set as the recessed area 94*b*.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A liquid discharge head, comprising:

a nozzle plate including a plurality of nozzles to discharge droplets;

a channel plate containing a plurality of individual channels communicating with the nozzles;

a wall member forming at least one portion of a wall of the plurality of individual channels; and a common liquid chamber, arranged at a side opposite the plurality of individual channels with the wall member therebetween, to supply liquid to the plurality of individual channels, the wall member including:

a deformable damper area forming one portion of a wall of the common liquid chamber, a reinforced area dividing the damper area into a plurality of areas in a nozzle arrangement direction, and an area of reduced thickness, arranged in at least one portion of the reinforced area, having a thickness greater than the damper area and less than the reinforced area.

2. The liquid discharge head according to claim 1, wherein the wall member includes a plurality of layers laminated one on another, the damper area includes one layer, the reinforced area includes three layers, and the area of reduced thickness, having the thickness greater than the damper area and less than the reinforced area, includes two layers.

3. The liquid discharge head according to claim 1, wherein the wall member is made of electroplated nickel.

4. An image forming apparatus comprising a liquid discharge head, the liquid discharge head including, a nozzle plate including a plurality of nozzles to discharge droplets, a channel plate containing a plurality of individual channels communicating with the nozzles, a wall member forming at least one portion of a wall of the plurality of individual channels, and a common liquid chamber, arranged at a side opposite the plurality of individual channels with the wall member therebetween, to supply liquid to the plurality of individual channels, the wall member including, a deformable damper area forming one portion of a wall of the common liquid chamber, a reinforced area dividing the damper area into a plurality of areas in a nozzle arrangement direction, and an area of reduced thickness, arranged in at least one portion of the reinforced area, having a thickness greater than the damper area and less than the reinforced area.

* * * * *